US005425148A

United States Patent [19]

Ashcraft et al.

[11] Patent Number: 5,425,148

[45] Date of Patent: Jun. 20, 1995

[54] CONVERTIBLE FOOTBOARD FOR A PATIENT SUPPORT

[75] Inventors: David N. Ashcraft; Stephen E. Glover; Craig D. Ellis; Kenith W. Chambers, all of Charleston, S.C.

[73] Assignee: SS1 Medical Services, Inc., Charleston, S.C.

[21] Appl. No.: 139,526

[22] Filed: Oct. 20, 1993

[51] Int. Cl.[6] ..... A61G 7/08

[52] U.S. Cl. ..... 5/507.1; 5/508; 5/53.1

[58] Field of Search ..... 5/53.1, 280, 285, 308, 5/507.1; 108/49

[56] References Cited

U.S. PATENT DOCUMENTS

| | | | |
|---|---|---|---|
| 713,529 | 11/1902 | Swindell, Sr. | 5/507.1 |
| 3,465,373 | 9/1969 | Wilson | 5/531 X |
| 3,564,627 | 2/1971 | Allard et al. | 5/507.1 |
| 4,404,698 | 9/1983 | Koncelik et al. | 5/507.1 |
| 4,724,555 | 2/1988 | Poehner et al. . | |
| 5,279,010 | 1/1994 | Ferrand et al. | 5/507.1 X |

FOREIGN PATENT DOCUMENTS

| | | | |
|---|---|---|---|
| 324237 | 7/1989 | European Pat. Off. . | |
| 700055 | 2/1931 | France . | |
| 811006 | 4/1937 | France . | |
| 477876 | 10/1969 | Switzerland . | |
| 737188 | 9/1955 | United Kingdom | 5/53.1 |

*Primary Examiner*—Michael F. Trettel
*Attorney, Agent, or Firm*—Dority & Manning

[57] ABSTRACT

A bed footboard has a main body with a cavity that is configured to receive a panel and a pocket member behind the panel to store patient records. The panel is pivotally mounted in the cavity to permit access to the pocket member and records held in the pocket. The panel is slidable in the pivotal mounting and has a retaining lip that can be engaged to a retaining flange in the cavity to enable the panel to be retained partially within the cavity and disposed to serve as a writing surface. The panel has a biased retracting mechanism that enables the panel to be released from the pivotal mounting. The main body of the panel has channels in which bolts can be slidably extended above the top surface of the main body. The panel has openings configured to receive the bolts to enable the panel to be mounted above the top surface of the main body and serve as a utility tray.

20 Claims, 8 Drawing Sheets

CONVERTIBLE FOOTBOARD FOR A PATIENT SUPPORT

BACKGROUND OF THE INVENTION

The present invention relates to footboards for beds and more particularly to footboards that are convertible to perform more than one function.

Hospital rooms typically are not provided with much furniture beyond a bed, a bed stand, and perhaps a chair. The hospital bed typically is not provided with any storage space. Thus, when the hospital staff moves a patient's bed from one room to another while supporting the patient during the move, an additional member of the hospital staff may be required to gather the patient's personal effects and physically carry them to the new location.

Various hospital records associated with the care of a patient typically are kept on a clipboard that is attached to the footboard of the bed. This arrangement places these records in full view of persons, such as visitors, who do not need and perhaps should not have, access to such records. Moreover, the preparation of these records would be facilitated by a convenient writing surface in the vicinity of the footboard of the bed. Unless a food service tray happens to be on the bed at the time the records are being prepared, such writing surface often is not available.

OBJECTS AND SUMMARY OF THE INVENTION

It is a principal object of the present invention to provide a footboard that can be manipulated to perform other functions useful in the hospital environment.

It also is a principal object of the present invention to provide a bed footboard with a manually detachable panel that can be manipulated to perform other functions that are useful in a hospital environment.

It is a further principal object of the present invention to provide a bed footboard with the capability of storing patient records out of clear view, yet easily accessible to hospital staff when needed.

Another principal object of the present invention is to provide a bed footboard with a panel that is easily and quickly manipulated by hand to assume an orientation that provides a convenient writing surface for the preparation of patient records.

Yet another principal object of the present invention is to provide a bed footboard with a panel that can be manually deployed at the foot of the bed to serve as a utility shelf that can function equally well while the bed is stationary or being moved from one location to another.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, a convertible footboard includes a main body having a front surface and a top surface. The main body is configured with various components which are disposed internally of the main body. The footboard includes a storage cavity defined in a portion of the main body. The storage cavity can include a rear wall which is disposed generally parallel to and recessed away from, the front surface of the main body. The storage cavity also can be defined by a top side wall, a bottom side wall that is disposed generally opposite to top side wall, a left side wall that is disposed normally to the rear wall and extends between the top and bottom side walls, and a right side wall disposed normally to the rear wall and opposite the left side wall and extending between the top and bottom side walls. Moreover, the left side wall of the storage cavity is configured with a left hand cutout, and the right side wall is configured with a right hand cutout. In addition, a pocket member can be disposed in the storage cavity and attached to the rear wall to form a pocket that provides a convenient space for holding patient records used by the hospital staff and normally hidden from view within the storage cavity but readily accessible when needed by the staff.

In still further accordance with the present invention, a panel is provided and configured to be received in the storage cavity. As embodied herein, the panel is defined by a front surface, a back surface disposed opposite the front surface, a left side surface disposed between the left side of the front surface and the left side of the back surface, a right side surface disposed between the right side of the front surface and the right side of the back surface and opposite to the left side surface. The panel is configured with various components which are disposed internally of the panel.

In yet further accordance with the present invention, a means can be provided for mounting the panel in the storage cavity. A means for mounting the panel in the storage cavity can include a left hole defined in the left side wall of the cavity near the top side wall of cavity and a right hole defined in the right side wall of the cavity near the top side wall of cavity. A means for mounting the panel in the storage cavity can include a right elongated pin extending away from the right side surface of the panel and having a cross-sectional shape configured to pivot within the right hole. A means for mounting the panel in the storage cavity can include a left elongated pin extending away from left side surface of panel and having a cross-sectional shape that is Configured to pivot within the left hole in the left side wall of the cavity. In this way, the holes and pins provide a means for pivotally mounting the panel in the storage cavity. Desirably, both the left and right holes are configured in an elongated fashion that extends in a plane that is generally horizontal and therefore normal to the vertical plane in which the front surface of the lower portion of main body generally resides. Desirably, each of elongated right and left holes in each of the respective right and left side walls of the storage cavity has a front end disposed opposite a rear end. Moreover, a pair of inclined guides is disposed near the top side wall of storage cavity. Each inclined guide desirably is disposed in communication with the front end of at least one of the elongated right and left holes. Each inclined guide functions to guide the respective left elongated pin and right elongated pin into the respective elongated hole disposed in the respective left and right side walls of the storage cavity.

In still further accordance with the present invention, a means for mounting the panel in the storage cavity can include a means for magnetically engaging the panel in the storage cavity. As embodied herein, a means for magnetically engaging the panel in the storage cavity can include at least a first magnetic coupling element disposed to extend from the rear wall of the storage cavity. Moreover, a means for magnetically engaging the panel in the storage cavity also can include at least a second magnetic coupling element disposed on the back surface of the panel in a manner that will be in registry with the first magnetic coupling element when the panel is received in the storage cavity.

In further accordance with the present invention, a means can be provided for releasing the panel from being mounted in the storage cavity. As embodied herein, a means for releasing the panel from being mounted in the storage cavity can include at least a first gripping cavity disposed near one of the left or right side surfaces of the panel and recessed from the back surface of the panel. Desirably, a second gripping cavity is configured and disposed on the other side surface of the panel in a similar fashion. A means for releasing the panel from being mounted in the storage cavity also can include a slot in the form of an elongated cylindrical opening formed in the panel near the gripping cavity and in registry with an opening formed in the adjacent side surface of the panel. A means for releasing the panel from being mounted in the storage cavity also can include a first elongated pin that extends from one of the left and right side surfaces of the panel and through the opening therein. The first elongated pin has a circular cross-sectional shape and is slidably received in the slot formed in the panel in registry with the opening through the adjacent side surface of the panel. The end of the elongated pin opposite the end that extends beyond the side surface of the panel, is biased by a coiled spring which desirably is formed of metal and is received in the slot. A second elongated pin, slot, and spring can form part of the panel releasing means and can be configured and disposed in a similar fashion on the opposite side, left or right, of the panel.

A means for releasing the panel from being mounted in the storage cavity also can include at least a first lever pivotally mounted in the first gripping cavity. The lever can be formed as a rigid rod that is bent about a generally central portion along the length of the rod. Desirably, a pivot post is disposed and mounted within the first gripping cavity, and the first lever is pivotally mounted to pivot about the post. The elongated pin can pivotally engage a first end of the lever. A means for releasing the panel from being mounted in the storage cavity also can include a first handle that is disposed in the first gripping cavity and is connected to a second end of the lever opposite the first end of the lever pivotally connected to the elongated pin.

In still further accordance with the present invention, a means can be provided for partially retaining the panel in the storage cavity in an inclined position relative to the front surface of the main body. As embodied herein, the partial retaining means can include a retaining lip disposed to extend from the front surface of the panel along a front edge of the panel. A partial retaining means also can include a retaining flange disposed to extend from the top side wall of the storage cavity. In addition, the partial retaining means also can include the left and right elongated holes in which the panel is pivotally and slidably mounted via the respective left and right elongated pins. In this way the retaining lip can engage the retaining flange when the front surface of the panel is disposed at an acute angle relative to the front surface of the main body.

In still further accordance with the present invention, a means can be provided for mounting the panel above the top surface of the main body. As embodied herein, a means for mounting the panel above the top surface of the main body can include an elongated first channel defined in the main body and extending through the top surface of the main body. The first channel can be defined between the front and rear surfaces of the main body and extending within the upper portion of the main body. A means for mounting the panel above the top surface of the main body also can include a first locking groove defined in the main body and having a first portion joining transversely to the first channel. A means for mounting the panel above the top surface of the main body also can include a first bolt having an elongated first shaft that can be slidably disposed in the first channel of the main body. The first bolt can have a handle portion extending transversely of the first shaft so that the handle portion can be slidably received in the first locking groove while a tapered end portion of the first shaft extends above the top surface of the main body.

A means for mounting the panel above the top surface of the main body also can include a first opening that can extend into the panel from the back surface of the panel. The first opening is configured and disposed to receive therein the tapered end portion of the first shaft when the end portion extends above the top surface of the main body. A means for mounting the panel above the top surface of the main body also can include a second elongated channel in the upper portion of main body, a second locking groove, a second bolt, and a second opening can be provided to extend into the back side of the panel.

The accompanying drawings, which are incorporated in and constitute a part of this specification, illustrate one embodiment of the invention and, together with the description, serve to explain the principles of the invention.

DETAILED DESCRIPTION OF THE PREFERRED EMBODIMENTS

Reference now will be made in detail to the presently preferred embodiments of the invention, one or more examples of which are illustrated in the accompanying drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of the appended claims and their equivalents. The same numerals are applied to the same features throughout the written description and drawings.

Figure 1:
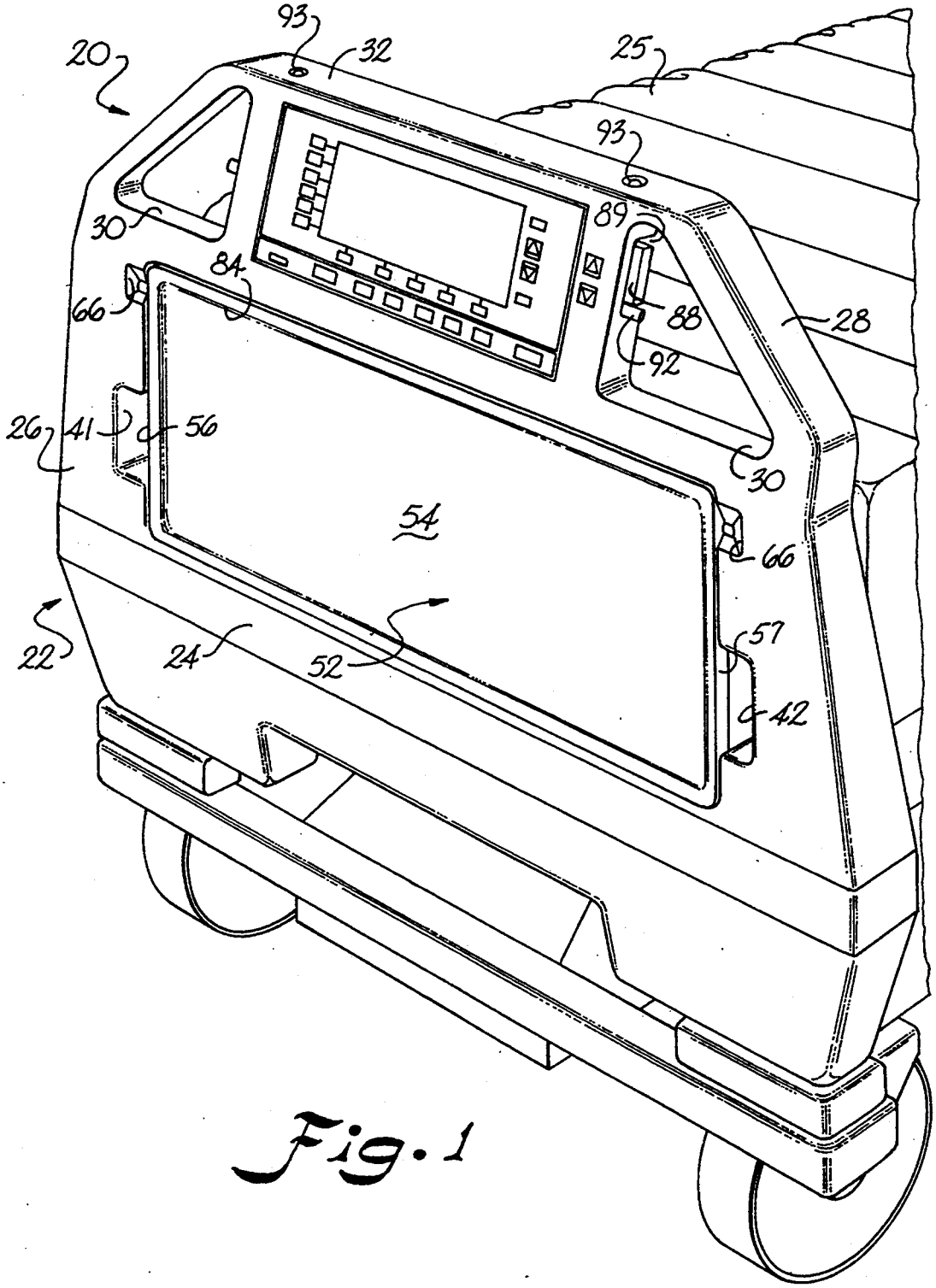
FIG. 1 is an elevated perspective view of an embodiment of the present invention.
Figure 2:
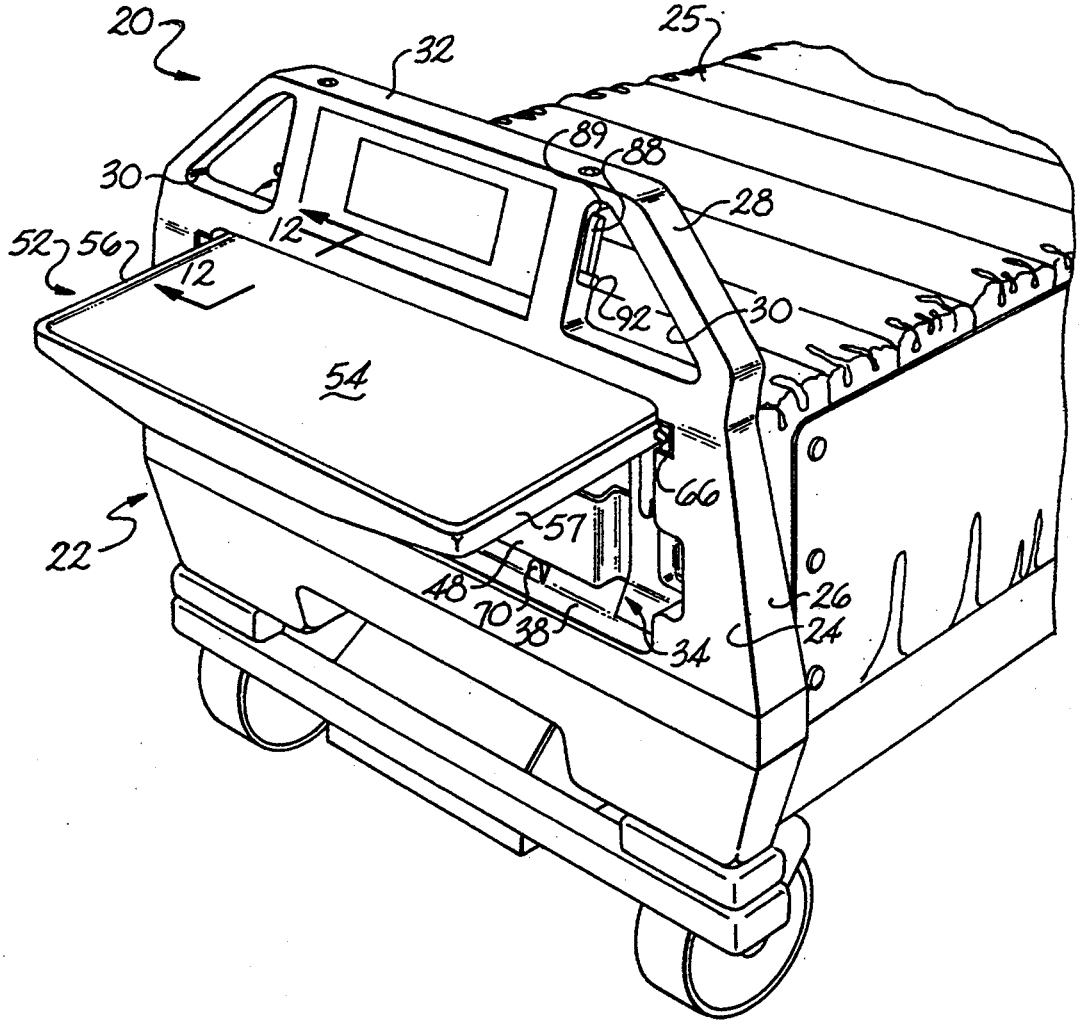
FIG. 2 is an elevated perspective view of the embodiment shown in FIG. 1, but with the panel elevated and engaged in the writing position.
Figure 3:
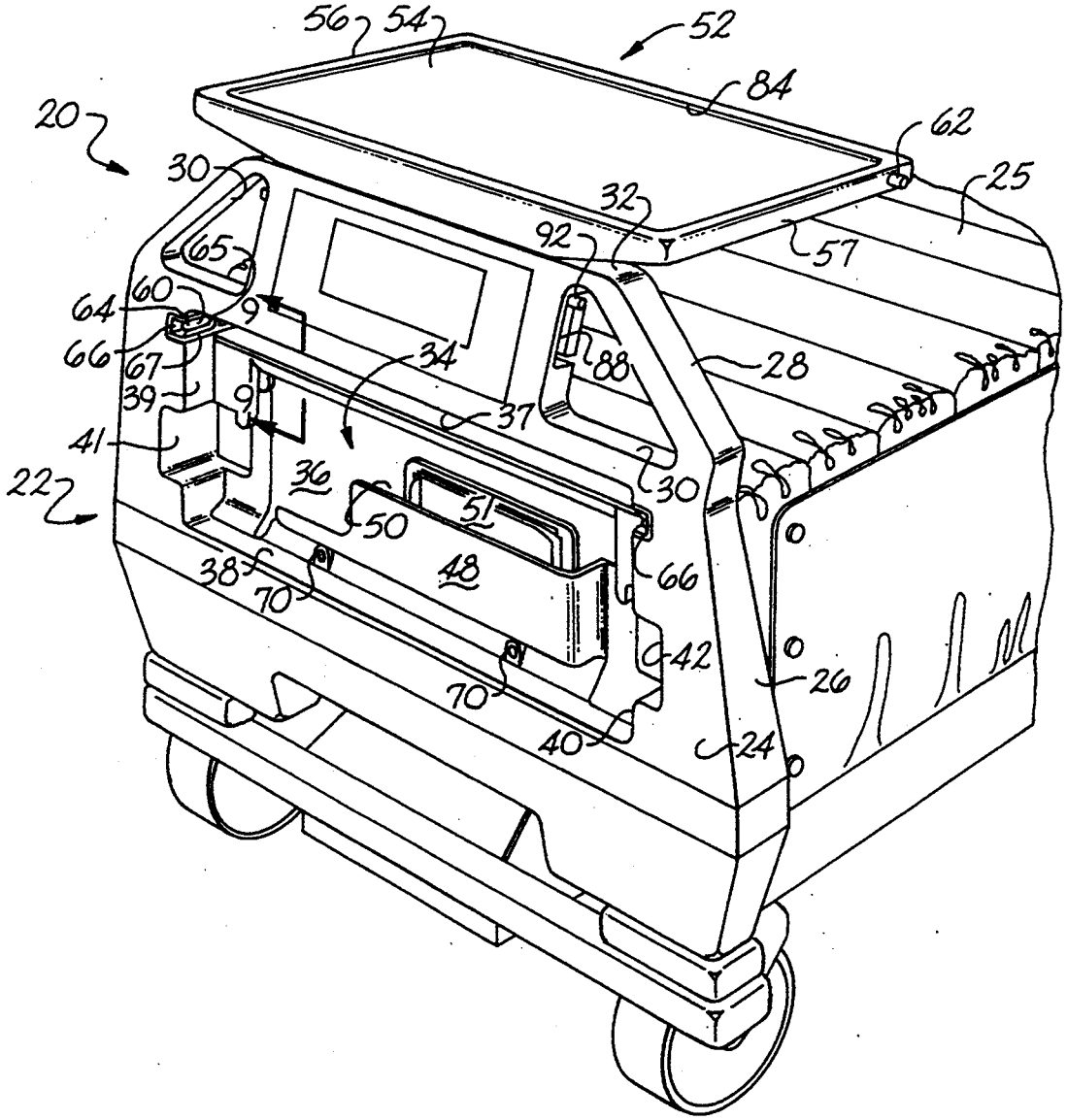
FIG. 3 is an elevated perspective view of the embodiment of the present invention shown in FIG. 1, but with the panel removed from the footboard's storage cavity and mounted on the top surface of the footboard in the utility shelf position.

A preferred embodiment of the convertible footboard of the present invention is shown in FIGS. 1–3 for example and is represented generally by the numeral 20.

In accordance with the convertible footboard of the present invention, a main body is provided having a front surface and a top surface. As embodied herein and shown in FIGS. 1–3 for example, a main body is indicated generally by the designating numeral 22. Main body 22 desirably has a front surface 24 which is disposed to face away from the patient support surface 25 of the bed when constructed in place as the footboard of a bed. The lower portion 26 of main body 22 desirably has its front surface 24 disposed in a generally vertical plane when main body 22 is constructed in place as the footboard of a bed. As shown in FIGS. 1–3, the upper portion 28 of main body 22 desirably is tilted at an angle away from the lower portion 26 of main body 22 and is inclined toward the patient support surface 25 of the bed when main body 22 is constructed in place as the footboard of the bed. As shown in FIGS. 1–3, the upper portion 28 of main body 22 can be configured with hand hold cutouts 30, one disposed on the left side of footboard 20 and the other disposed on the right side of footboard 20.

Main body 22 desirably can be formed of a rigid material such as metal and/or polycarbonate and/or resin and/or wood. Main body 22 desirably can be formed in more than one piece which can be joined together by conventional fastening means. This multiple-piece construction facilitates the configuration of the various components which are described hereafter and disposed internally of main body 22.

As shown in FIGS. 1–3, 7 and 8 for example, main body 22 has a top surface 32 which defines a generally horizontal surface at the uppermost portion of main body 22. The length of top surface 32 extends substantially the width of the patient support surface 25 reduced by the extent of the cutouts 30 disposed on opposite sides of the upper portion 28 of main body 22. The width of top surface 32 desirably extends the full depth of the upper portion 28 of main body 22.

Figures 9, 9A:
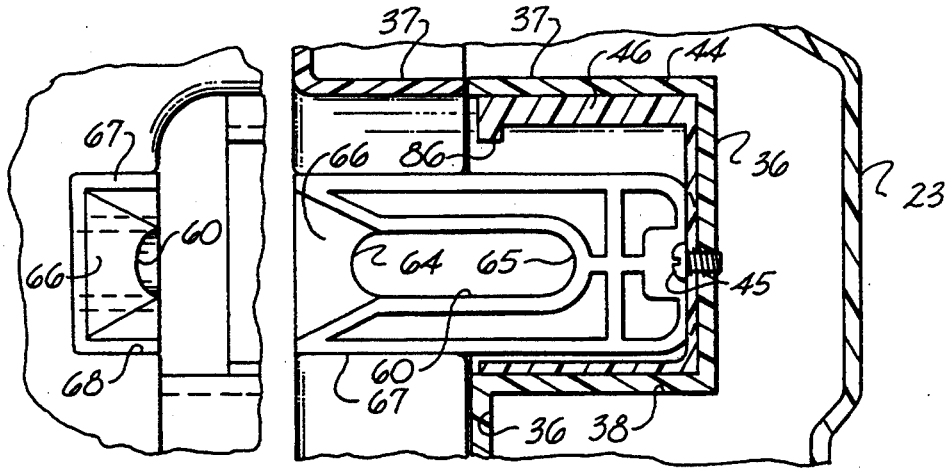
FIG. 9 is a partial cross-sectional view and partial plan view taken in the direction in which arrows 9—9 are pointing in FIG. 3.
FIG. 9A is a partial elevational view taken in a direction perpendicular to the direction in which arrows 9—9 are pointing in FIG. 3 and showing the inclined member without the tray being inserted in the elongated hole that is disposed behind the inclined member in this view.
Figures 11, 11A:
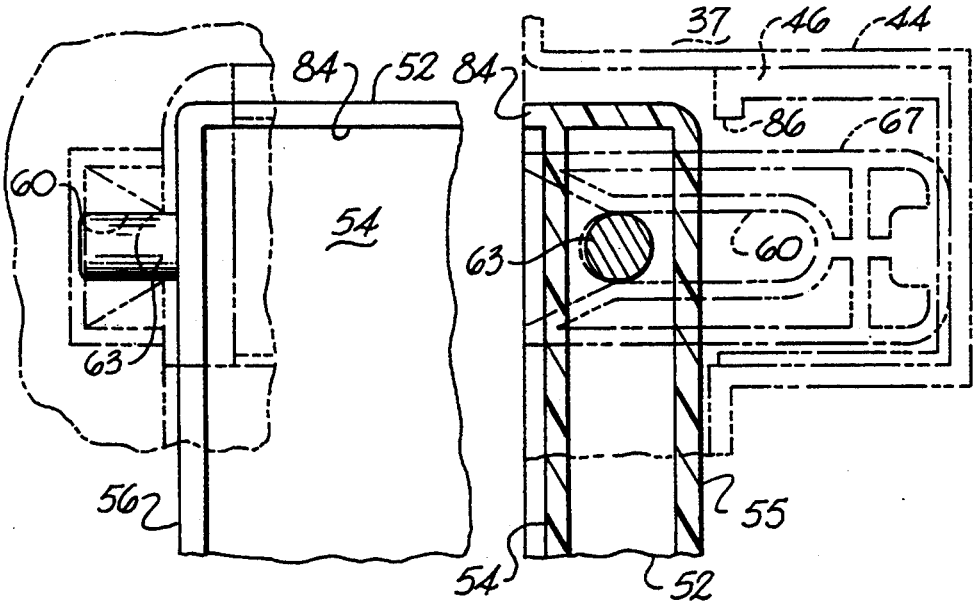
FIG. 11 is a partial cross-sectional view taken in the same direction as the arrows 9—9 are pointing in FIG. 3, but with the panel and the elongated pin shown in cross-section and the elongated hole and components of the main body of the footboard shown in phantom (dashed line)
FIG. 11A is a view similar to that of FIG. 9A except that the panel is shown in solid line and the components of the main body of the footboard are shown in phantom (dashed line)
Figure 12:
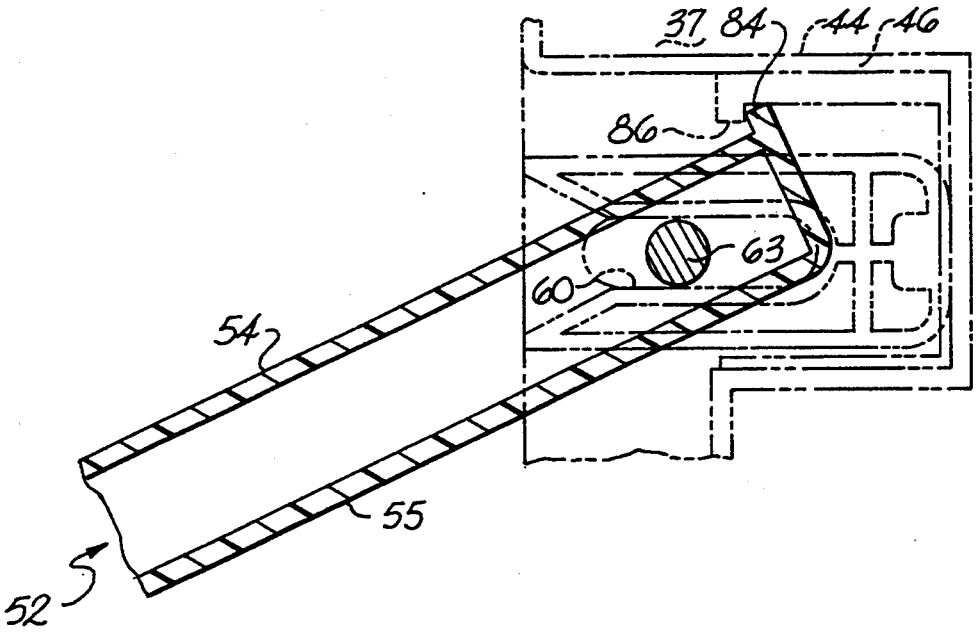
FIG. 12 is a partial cross-sectional view taken in the same direction as the arrows 12—12 are pointing in FIG. 2, and is a view similar to that of FIGS. 9 and 11 except that the panel and elongated pin are shown in cross-section and the components of the main body of the footboard are shown in phantom (dashed line) with the panel engaged in the writing position.

In further accordance with the present invention, a storage cavity can be defined in a portion of the main body. The storage cavity is recessed from the front surface of the main body. As embodied herein and shown in FIGS. 2 and 3 for example, a storage cavity is generally indicated by designating numeral 34. As shown in FIG. 3 for example, storage cavity 34 is defined in the lower portion 26 of main body 22 and can include a rear wall 36 which is disposed generally parallel to front surface 24 of main body 22 and recessed away from front surface 24 of main body 22. In addition to rear wall 36, storage cavity 34 can be defined by a top side wall 37 which is shown in FIGS. 9, 11 and 12 for example. As shown in FIGS. 2 and 3 for example, storage cavity 34 can be defined by a bottom side wall 38 that is disposed generally opposite to top side wall 37. As shown in FIG. 3 for example, storage cavity 34 can be defined by a left side wall 39 that is disposed normally to rear wall 36 and extending between top side wall 37 and bottom side wall 38. Similarly, storage cavity 34 can be defined by a right side wall 40 disposed normally to rear wall and opposite left side wall 39 and extending between top side wall 37 and bottom side wall 38.

As shown in FIGS. 1 and 3 for example, left side wall 39 of storage cavity 34 can be configured with a left hand cutout 41, and right side wall 40 of cavity 34 can be configured with a right hand cutout 42. As shown in FIG. 3, a pocket member can be disposed in storage cavity 34 and attached to rear wall 36 thereof. As shown in FIG. 9 for example, a preformed sleeve 44 is formed of rigid material and attached in contact with the rear wall 36, top side wall 37 and bottom side wall 38 of the upper region of storage cavity 34. Several screws 45 attach a U-shaped insert 46 into the U-shaped portion of sleeve 44 (also shown in FIG. 10). As shown in FIG. 3 for example, a pocket member 48 forms a pocket 50 that provides a convenient space for holding patient records 51 used by the hospital staff and normally hidden from view within storage cavity 34 but readily accessible within storage cavity 34 when needed by the staff.

Figure 4:
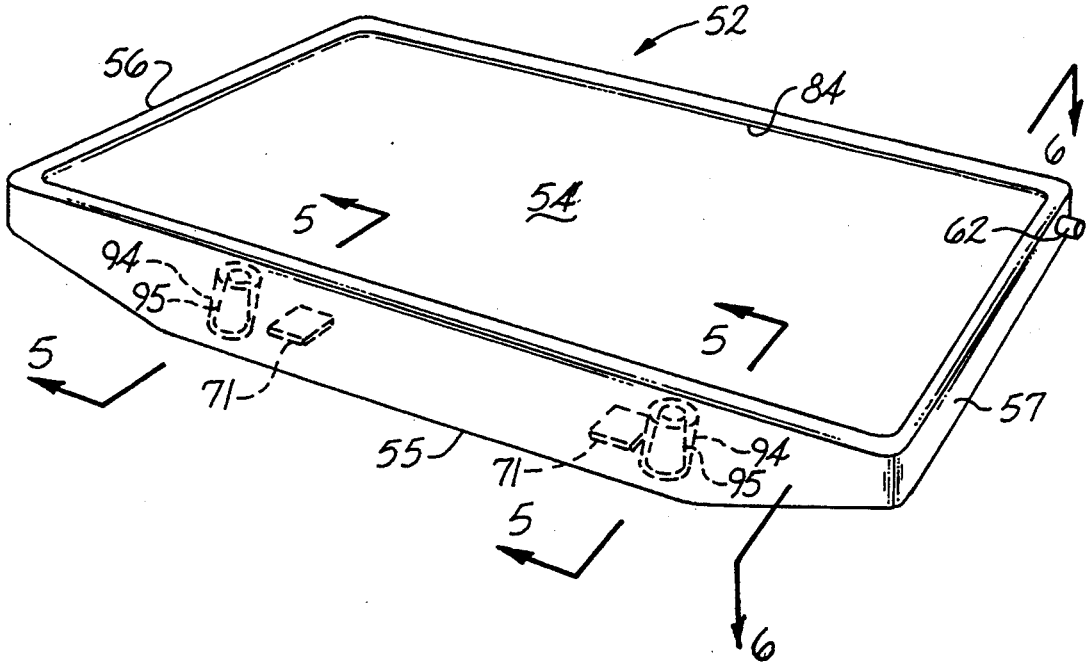
FIG. 4 is an elevated perspective view of the panel removed from the footboard.
Figure 5:
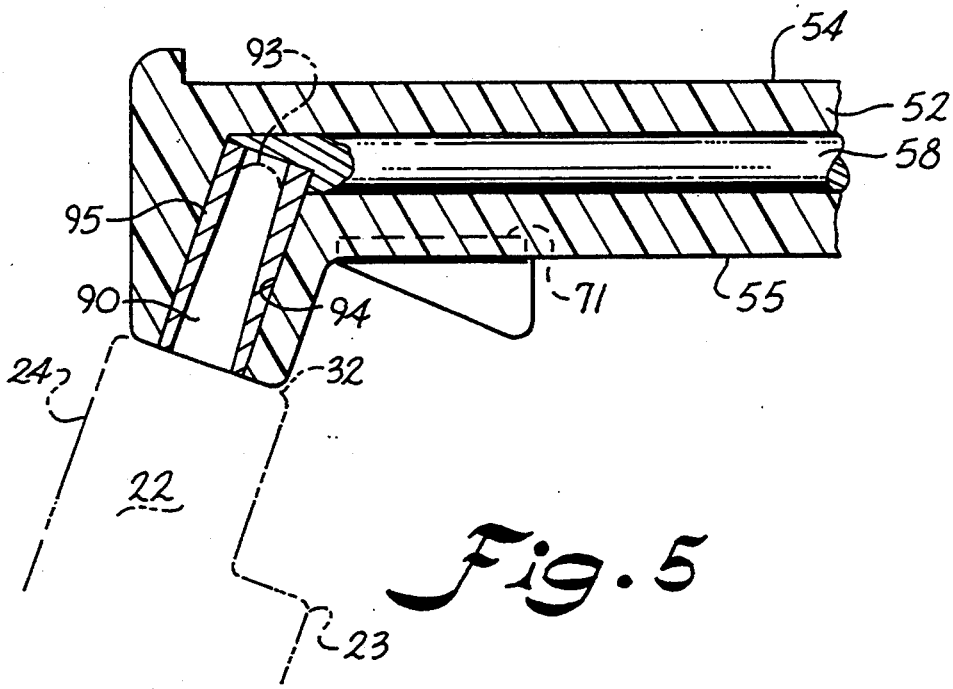
FIG. 5 is a partial cross-sectional view looking in the direction in which each set of arrows 5—5 are pointed in FIG. 4 and showing in phantom (dashed lines) the upper portion of the footboard and the extended mounting bolt.

In still further accordance with the present invention, a panel is provided and configured to be received in the storage cavity. As embodied herein and shown in FIGS. 1–4 and 12, a panel is indicated generally by the designating numeral 52. As shown in FIGS. 1–4 for example, panel 52 is configured to be received in storage cavity 34 and is defined by a front surface 54. As shown in FIGS. 5, 11 and 12 for example, panel 52 also includes a back surface 55 disposed opposite front surface 54. As shown in FIGS. 1–4 and 11A, panel 52 has a left side surface 56, which is disposed between the left side of front surface 54 and the left side of the back surface (not visible in these Figs) of panel 52. Similarly, as shown in FIGS. 1–4 and 6, panel 52 has a right side surface 57 disposed between the right side of front surface 54 and the right side of the back surface (not seen in these Figs.) and opposite to left side surface 56. Desirably, panel 52 is formed of a rigid material such as metal and/or polycarbonate and/or resin and/or wood. As shown in FIG. 5, panel 52 can be reinforced with one or more metal rods 58 extending parallel to and between front surface 54 and back surface 55 of panel 52. Panel 52 desirably can be formed in more than one piece which can be joined together by conventional fastening means. This multiple-piece construction facilitates the configuration of the various components which are described hereafter and disposed internally of panel 52.

Figure 6:
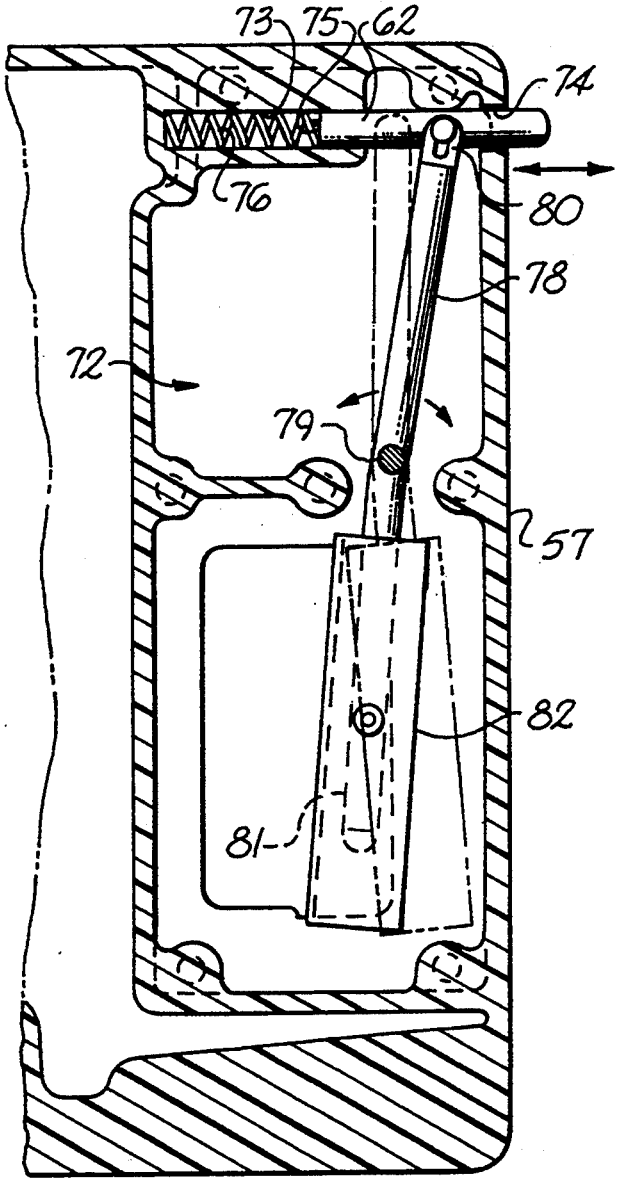
FIG. 6 is a cross-sectional view looking in the direction in which arrows 6—6 are pointing in FIG. 4 and showing in phantom a retracted position of spring mounted elongated pin and its pivotally connected lever and handle.

In yet further accordance with the present invention, a means can be provided for mounting the panel in the storage cavity. As embodied herein and shown in FIGS. 3, 9–11, 11A and 12 for example, a means for mounting the panel in the storage cavity can include a left hole 60 defined in left side wall 39 of storage cavity 34 near top side wall 37 of cavity 34. Though not visible in the Figs. because of the view taken, a similarly configured right hole is defined in the right side wall of the cavity near the top side wall of cavity. As shown in FIGS. 3, 4 and 6, a means for mounting the panel in the storage cavity can include a right elongated pin 62 extending away from right side surface 57 of panel 52. Right pin 62 has a cross-sectional shape configured to pivot within the right hole that is disposed in the right side wall 40 of storage cavity 34. As shown in FIGS. 11, 11A, and 12 for example, a means for mounting the panel in the storage cavity similarly can include a left elongated pin 63 extending away from left side surface 56 of panel 52. Left pin 63 also has a cross-sectional shape that is configured to pivot within left hole 60 in left side wall 39 of cavity 34. In this way, holes 60 and pins 62, 63 provide a means for pivotally mounting the panel in the storage cavity.

Figure 10:
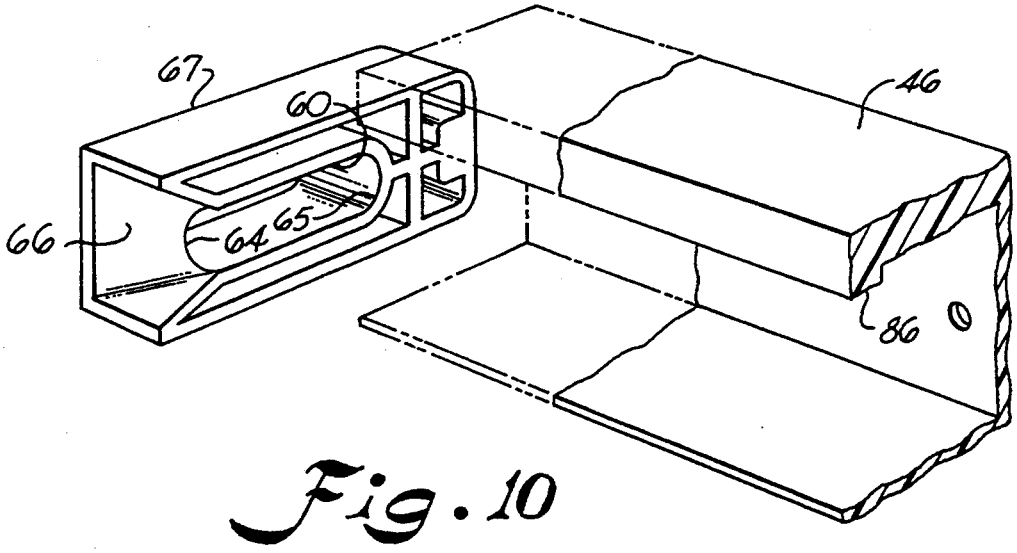
FIG. 10 is an elevated perspective view of components of the main body of the footboard which are configured to receive components of the panel.

As shown in FIGS. 3, 9, 10, 11 and 12, at least left hole 60 in left side wall 39 of storage cavity 34 is elongated in a direction that is generally along a line that is normal to front surface 24 of main body 22. Desirably, both left hole 60 and the corresponding mirror image right hole are so configured in this elongated fashion that extends in a plane that is generally horizontal and therefore normal to the vertical plane in which front surface 24 of the lower portion 26 of main body 22 generally resides. Desirably, as shown in FIGS. 3, 9 and 10 for example, each of elongated right and left holes 60 in each respective right and left side walls 40, 39 of storage cavity 34 has a front end 64 and a rear end 65. As schematically shown in FIG. 3 for example, front end 64 is disposed closer to front surface 24 of main body 22 than rear end 65 of left elongated hole 60. Similarly, rear end 65 of elongated hole 60 is disposed closer to rear wall 36 of storage cavity 34 than front end 64 of elongated hole 60.

Moreover, as shown in FIGS. 1–3, 9, 9A and 10 for example, an inclined guide 66 is disposed near top side wall 37 of storage cavity 34. Desirably, a pair of inclined guides 66 is disposed near top side wall 37 of storage cavity 34. As shown in FIGS. 9 and 10 for example, each inclined guide 66 desirably is disposed in communication with the front end 64 of at least one of elongated right and left holes 60. As explained below, inclined guide 66 functions to guide the respective left elongated pin 63 and right elongated pin 62 into the respective elongated hole disposed in respective left and right side walls 39, 40 of storage cavity 34. As shown in FIGS. 3, 9, 9A and 10, a preformed unitary structure 67 may be configured to define each inclined guide 66 and communicating elongated hole 60, and this unitary structure 67 may be received and conventionally secured in a cutout portion 68 (FIG. 9A) of each side wall defining storage cavity 34.

In still further accordance with the present invention, a means for mounting the panel in the storage cavity can include a means for magnetically engaging the panel in the storage cavity. As embodied herein and shown in FIG. 3 for example, a means for magnetically engaging the panel in the storage cavity can include at least a first magnetic coupling element 70 disposed to extend from rear wall 36 of storage cavity 34. As schematically shown in phantom in FIG. 3, desirably a pair of first magnetic coupling elements is disposed to extend from rear wall 36 of storage cavity 34. Moreover, as schematically shown in phantom (dashed line) in FIG. 4 for example, a means for magnetically engaging the panel in the storage cavity also can include at least a second magnetic coupling element 71 disposed on back surface 55 of panel 52 in a manner that will be in registry with first magnetic coupling element 70 extending from rear wall 36 of storage cavity 34 when panel 52 is received in storage cavity 34. Desirably, a pair of second magnetic coupling elements 71 are disposed on back surface of panel 52. Each second magnetic coupling element 71 is disposed to be in registry with a respective first magnetic coupling element 70 when panel 52 is received in storage cavity 34. As shown in FIGS. 3 and 4, back surface 55 of panel 52 is configured to present second magnetic coupling elements 71 into contact with first magnetic coupling elements 70 when panel 52 is received in storage cavity 34. In the embodiment shown in FIGS. 3 and 4, first magnetic coupling elements 70 desirably are formed as magnets which are attached to rear wall 36 of storage cavity 34, while second magnetic coupling elements 71 are configured as metal plates which are attached to back surface 55 of panel 52. However, second magnetic coupling element 71 can be a magnet of an opposite polarity to a magnet forming first magnetic coupling element 70, or first magnetic coupling element 70 can be a metal plate so long as second magnetic coupling element 71 is a magnet.

In further accordance with the present invention, a means can be provided for releasing the panel from being mounted in the storage cavity. As embodied herein and shown in FIG. 6 for example, the means for releasing the panel from being mounted in the storage cavity can include at least a first gripping cavity indicated generally by the designating numeral 72. First gripping cavity 72 desirably is disposed near one of left side surface 56 or right side surface 57 of panel 52 and recessed from back surface 55 of panel 52. Manual access to first gripping cavity 72 is had from back surface 55 of panel 52. Desirably, a second gripping cavity is disposed in a similar fashion on the other side surface 56 or 57 of panel 52. As shown in FIG. 6, a right gripping cavity 72 is disposed near right side surface 57 of panel 52 and recessed from back surface 55.

As shown in FIG. 6 for example, a means for releasing the panel from being mounted in the storage cavity also can include a slot 73 in the form of an elongated cylindrical opening formed in panel 52 near gripping cavity 72 and in registry with an opening 74 formed in the adjacent side surface 57 of panel 52. A means for releasing the panel from being mounted in the storage cavity also can include a first elongated pin 62 that extends from one of the left and right side surfaces 56, 57 of panel 52 and through the opening 74 therein. As shown in FIG. 6, a first elongated pin 62 extends from right side surface 57 of panel 52 and has a circular cross-sectional shape. As shown in FIG. 6, elongated pin 62 is slidably received in slot 73 formed in panel 52 in registry with opening 74 through the adjacent side surface 57 of panel 52. The end 75 of elongated pin opposite the end that extends beyond side surface of panel 52, is biased by a coiled spring 76 which desirably is formed of metal and is received in slot 73. A second elongated pin, slot, and spring can form part of the panel releasing means and can be configured and disposed in a similar fashion on the opposite side, left or right, of panel 52.

A means for releasing the panel from being mounted in the storage cavity also can include at least a first lever pivotally mounted in first gripping cavity. As shown in FIG. 6 for example, a first lever 78 is a rigid rod that is bent about a generally central portion along the length of the rod. Desirably, a pivot post 79 is disposed and mounted within first gripping cavity 72, and first lever 78 is pivotally mounted to pivot about post 79 as shown in FIG. 6 for example. As further shown in FIG. 6, elongated pin 62 can pivotally engage a first end 80 of lever 78. A means for releasing the panel from being mounted in the storage cavity also can include a first handle 82 that is disposed in the first gripping cavity 72. As shown in FIG. 6 for example, a right handle 82 is disposed in right gripping cavity 72 and is connected to a second end 81 of lever 78 opposite the first end 80 of lever 78.

First lever 78 and handle 82 are depicted in FIG. 6 both in solid line and in dashed line to indicate two extreme orientations that can be taken by being pivoted about post 79. The dashed line depiction shows the orientation wherein a person would squeeze handle 82 toward right side surface 57 of panel 52 and move elongated pin 62 away from right side surface 57 of panel 52 and against the biasing force of spring 76 so that panel 52 could be removed from storage cavity 34 when elongated pin 62 was retracted to permit clearance past front end 64 of elongated hole 60. In this disposition, pin 62 would be retracted from elongated hole 60. Desirably, a similar configuration of lever, post and handle is on the left side of panel 52, and this left handle would be gripped by the left hand of the person and squeezed simultaneously in a similar fashion to retract the left elongated pin from the left hole in left side wall 39 of storage cavity 34. The solid line depiction in FIG. 6 shows the orientation of elongated pin 62, lever 78 and handle 82 when no pressure is being applied against handle 82 and spring 76 biases elongated pin 62 in the fully extended position beyond the boundary formed by right side surface 57 of panel 52. As panel 52 is moved into storage cavity 34, elongated pin 62 slides along the inclined surface of inclined guide 66 and elongated pin 62 is moved inwardly against the biasing force of spring 76 until panel 52 is moved sufficiently into storage cavity 34 that elongated pin 62 ceases contact with inclined guide 66 and spring 76 forces elongated pin 62 into elongated hole 60 as shown in FIGS. 11 and 12 for example. As shown in FIG. 11A, elongated pin 62 is fully extended and has moved past inclined guide 66 near front end 64 of elongated hole 60.

In still further accordance with the present invention, a means can be provided for partially retaining the panel in the storage cavity in an inclined position relative to the front surface of the main body. As embodied herein and shown in FIGS. 1, 3, 4, 11, 11A and 12 for example, the partial retaining means can include a retaining lip 84 disposed to extend from front surface 54 of panel 52 along a front edge of panel 52. As shown in FIGS. 9, 10, 11 and 12 for example, the partial retaining means also can include a retaining flange 86 disposed to extend from top side wall 37 of storage cavity 34. As shown in FIGS. 11 and 12, retaining flange 86 is integrally formed as part of U-shaped insert 46. In addition, a partial retaining means also can include left elongated hole 60 and a corresponding right elongated hole in which panel 52 is pivotally and slidably mounted via respective left and right elongated pins 62. In this way retaining lip 84 can engage retaining flange 86 when front surface 54 of panel 52 is disposed at an acute angle relative to front surface 24 of main body 22. As shown in FIGS. 2 and 12, when retaining lip 84 engages retaining flange 86, front surface 54 of panel 52 is disposed at about 10° below the horizontal plane and front surface 54 of panel 52 is disposed at an acute angle of about 80° relative to front surface 24 of main body 22.

In still further accordance with the present invention, a means can be provided for mounting the panel above the top surface of the main body. As embodied herein and shown in FIGS. 1–3, 7 and 8, a means for mounting the panel above the top surface of the main body can include an elongated first channel 88 defined in main body 22 and extending through top surface 32 of main body 22. First channel 88 can be defined between the front and back surfaces 24, 23 of main body 22 and extending within the upper portion of main body 22.

Figure 8:
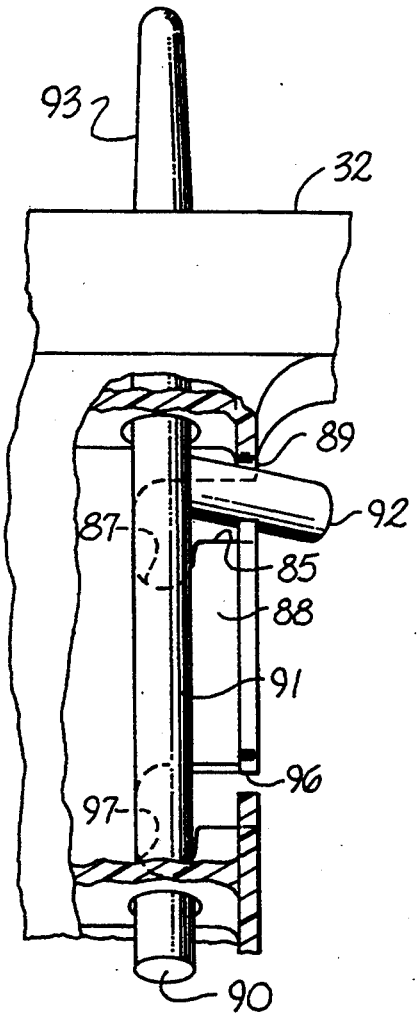
FIG. 8 is a partial cross-sectional and partial elevated perspective view of the elongated bolt extended from the channel of the main body of the footboard with portions cut away.

A means for mounting the panel above the top surface of the main body also can include a first locking groove 89 defined in main body 22. As shown in FIGS. 1–3, and 8, a first locking groove 89 can be defined in main body 22. As shown in FIG. 8, first locking groove 89 can have a first portion 85 joining transversely to first channel 88 and a downwardly extending drop portion 87 (dashed line).

Figure 7:
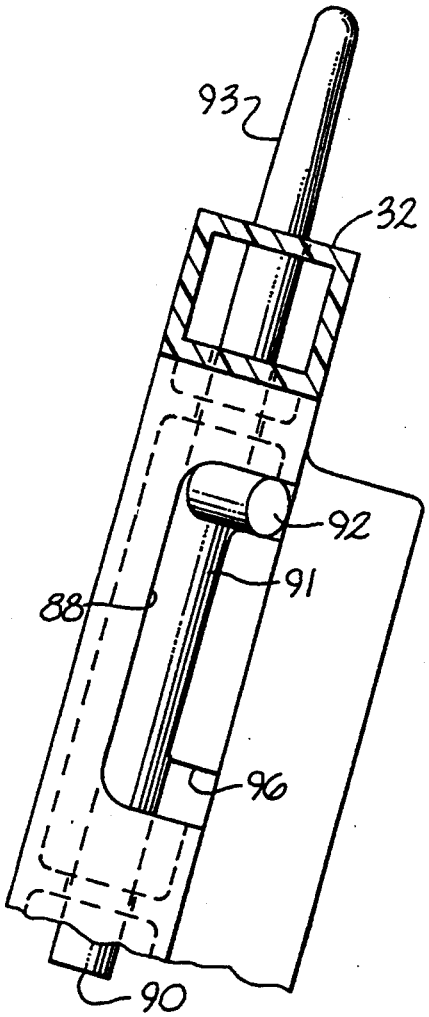
FIG. 7 is a partial cross-sectional and partial elevated perspective view of the elongated bolt extended from the channel of the main body of the footboard.

As shown in FIGS. 5, 7 and 8, a means for mounting the panel above the top surface of the main body also can include a first bolt 90. As shown in FIGS. 7 and 8, first bolt 90 can be solid and have an elongated first shaft 91. As shown in FIGS. 7 and 8, first shaft 91 can be slidably disposed in first channel 88 of main body 22. As shown in FIGS. 7 and 8, first bolt 90 can have a handle portion 92 (FIGS. 1–3) extending transversely of first shaft 91. The operator can grasp handle portion 92 to slidably extend bolt 90 above top surface 32 of main body 22. As shown in FIGS. 7 and 8, first bolt 90 can be configured so that handle portion 92 can be slidably received in drop portion 87 (dashed line in FIG. 8) of first locking groove 89 while an end portion 93 of first shaft 91 extends above top surface 32 of main body 22. As shown in FIGS. 5, 7 and 8, end portion 93 desirably is tapered in a conical fashion.

In addition, a means for mounting the panel above the top surface of the main body also can include a first opening. As shown in FIGS. 4 and 5, a first opening 94 can extend into panel 52 from back surface 55 of panel 52. First opening 94 is configured and disposed to receive therein tapered end portion 93 of first shaft 91 when end portion 93 extends above the top surface 32 of main body 22. As shown in FIGS. 4 and 5, first opening 94 of panel 52 can be lined with a cylindrical sleeve 95, which can be formed of metal and/or rigid plastic and desirably tapered in the form of a truncated conical section. Thus, by means of sleeve 95, opening 94 is configured to receive tapered end 93 of shaft 91. As shown in FIG. 5, front surface 54 of panel 52 is disposed in a generally horizontal position when first opening 94 receives therein end portion 93 of first shaft 91 extending above top surface 32 of main body 22. FIG. 5 shows the relative position of panel 52, end portion 93 of first bolt 90, and main body 22 (dashed line) that is also shown in FIG. 3 for example. A second elongated channel can be provided in the upper portion of main body 22 so that similarly configured right and left channels, right and left locking grooves, and right and left bolts with handles, are provided. In addition, as shown in FIG. 4 for example, a second opening 94 can be provided to extend into panel 52 from back surface 55 of panel 52. The left and right openings 94 are configured and disposed to receive therein, end portions 93 of respective left and right bolts 90 when end portions 93 extend above top surface 32 of main body 22. However, if only a single set of channels, bolts, and openings is provided, the orientation can be different from that shown in FIGS. 1–3 and 4, such as in the middle of top surface 32 of main body 22. Depending on the configuration (tapered or untapered) and lubrication (or not) of end portion 93 of bolt 91 and corresponding opening 94, this central orientation could permit panel 52 to be swiveled about the one elongated bolt. Moreover, only one of the elongated shafts, bolts, and openings could be in use in the configuration shown in FIGS. 1–3. This orientation also would permit panel 52 to be swiveled about the one elongated bolt provided the proper combination of configuration and lubrication of end portion 93 and corresponding opening 94.

Operation of the convertible footboard of the present invention can be implemented as follows. The hands of the operator would be placed in the respective left and right cutouts 41, 42 in main body 22 shown in FIG. 1 for example. The operator then would lift panel 52 up and away from main body 22. This lifting motion would be sufficient to disengage any magnetic coupling elements that might be provided on the particular embodiment of the footboard. The lifting motion can be continued while pins 62 of panel pivot within elongated holes 60 of the side walls 39, 40 of storage cavity 34 until the panel attains a position that is almost horizontal. During this lifting motion, the operator need not squeeze handles disposed in left and right gripping cavities 72, such as shown in FIG. 6. This is because at this point, the operator does not intend to remove panel 52 totally from within storage cavity 34. Once the almost horizontal position for the panel has been attained, the operator may slide panel 52 back towards rear wall 36 of cavity 34 such that elongated pins 62 move away from front end 64 of elongated holes 60 until retaining lip 84 on front surface 54 of panel 52 moves behind retaining flange 86 extending from top side wall 37 of storage cavity 34. Then, the operator can lower panel 52 until retaining lip 84 engages retaining flange 86 as shown in FIG. 12. In this orientation, panel 52 forms a writing surface that can be used by hospital staff to make notations on records of the patient. Such records 51 can be removed from behind pocket to member 48 shown in FIGS. 2 and 3 for example.

In preparing main body 22 for mounting panel 52 on top surface of main body 22, each bolt handle 92, left and right, would be manipulated from a drop portion 97 (shown in phantom in FIG. 8) of a retracted transverse groove 96 (FIG. 8) and moved vertically up to the respective transverse locking groove 89. The bolt handle 92 would be inserted into the transverse portion of the locking groove 89, to extend each respective end portion 93 of each respective elongated bolt 90 into a position extending above top surface 32 of main body 22 as shown in FIG. 5 for example. The bolt handle 92 would be allowed to rest in drop portion 87 of transverse locking groove 89, as this provides a stable receptacle for handle 92 while maintaining tapered end portion 93 of elongated bolt shaft 91 above top surface 32 of main body 22.

When the operator decides to remove panel 52 completely from within storage cavity 34 and mount it above top surface 32 of main body 22 as in FIG. 3, then the hands of the operator squeeze the left and right handles 82 disposed in left and right gripping cavities 72 recessed from back surface 55 of panel 52 and shown in FIG. 6 for example. Squeezing of handles 82 retracts elongated left and right pins 62 from within elongated left and right holes 60 formed in respective left and right side walls 39, 40 of storage cavity 34 of main body 22. Once elongated pins 62 are sufficiently retracted, panel 52 can be removed completely from storage cavity 34. Then the operator moves the panel until its openings 94 in back surface 55 are registered with extended end portions 93 of elongated bolts 90 and places openings 94 onto end portions 93 of bolts 90 to secure panel 52 into the utility tray position as shown in FIG. 3. To remove panel 52 from the utility tray orientation shown in FIG. 3, the operator merely lifts panel 52 vertically and slides end portions 93 of bolts 90 out of openings 94 or sleeves 95 (if any) lining openings 94.

When the operator wants to restore panel 52 into storage cavity 34, the operator places the left and right elongated pins 62 onto left and right inclined guides 66 and pushes panel 52 toward rear wall 36 of storage cavity 34 until elongated pins 62 are extending into left and right elongated holes 60 as shown in FIG. 9A for example. The operator then lowers panel 52 until the panel's magnetic coupling member(s) 71 engage the magnetic coupling member(s) 70 extending from main body 22.

WHAT IS CLAIMED IS:

1. A convertible footboard for a patient support, comprising:

a main body having a front surface and a top surface;

a storage cavity defined in a portion of said main body recessed from said front surface of said main body;

a panel configured to be received in said storage cavity;

a means for mounting said panel in said storage cavity; and a means for partially retaining said panel in said storage cavity in an inclined position relative to said front surface of said main body.

2. An apparatus as in claim 1, wherein:

said panel having a front surface and a back surface disposed opposite said front surface, said panel having a left side surface disposed between the left side of said front surface and the left side of said back surface, said panel having a right side surface disposed between the right side of said front surface and the right side of said back surface and opposite to said left side surface;

said storage cavity being defined by a rear wall, a top side wall disposed normally to said rear wall, a left side wall disposed normally to said rear wall and said top side wall, and a right side wall disposed normally to said rear wall and said top side wall and opposite said left side wall; and said means for partially retaining said panel in an inclined position in said storage cavity includes:

a retaining lip disposed to extend from said front surface of said panel along a front edge of said panel; and a retaining flange disposed to extend from said top side wall of said storage cavity.

3. An apparatus as in claim 2, wherein:

said storage cavity being further defined by a left side wall disposed normally to said rear wall and said top side wall, and a right side wall disposed normally to said rear wall and said top side wall and opposite said left side wall; and wherein said partial retaining means further includes:

a left hole defined in said left side wall of said cavity near said top side wall of said cavity, a right hole defined in said right side wall of said cavity near said top side wall of said cavity, each of said right and left holes in said respective right and left side walls of said storage cavity is elongated in a direction that is generally along a line that is normal to said front surface of said main body, wherein each of said elongated right and left holes in said respective right and left side walls of said storage cavity has a front end and a rear end, said front surface of said main body being closer to said front end than said rear end, said rear wall of said storage cavity being closer to said rear end than said front end, and wherein said panel is pivotally and slidably mounted in said elongated left and right holes so that said retaining lip can engage said retaining flange when said front surface of said panel is disposed at an obtuse angle relative to said front surface of said main body.

4. An apparatus as in claim 1, further comprising:

a means for mounting said panel above said top surface of said main body.

5. An apparatus as in claim 4, wherein said means for mounting said panel above said top surface of said main body includes:

an elongated first channel defined in said main body and extending through said top surface of said main body;

a first locking groove defined in said main body and having a first portion joining transversely to said first channel; and a first bolt having an elongated first shaft slidably disposed in said first channel of said main body, said first bolt having a handle portion extending transversely of said first shaft, said first bolt being configured so that said handle portion can be slidably received in said first locking groove while an end portion of said first shaft extends above said top surface of said main body.

6. An apparatus as in claim 5, wherein said means for mounting said panel above said top surface of said main body further includes:

a first opening extending into said panel from said back side of said panel;

wherein said first opening is configured and disposed to receive therein said end portion of said first shaft when said end portion extends above said top surface of said main body.

7. An apparatus as in claim 6, wherein said front surface of said panel is disposed in a generally horizontal position when said first opening receives therein said end portion of said first shaft extending above said top surface of said main body.

8. An apparatus as in claim 6, wherein said end portion of said first shaft extending above said top surface of said main body is configured to be tapered toward the free end of said shaft.

9. An apparatus as in claim 1, wherein:

said panel having a front surface and a back surface disposed opposite said front surface, said panel having a left side surface disposed between the left side of said front surface and the left side of said back surface, said panel having a right side surface disposed between the right side of said front surface and the right side of said back surface and opposite to said left side surface;

said storage cavity being defined by a rear wall, a top side wall disposed normally to said rear wall, a bottom side wall disposed opposite said top side wall, a left side wall disposed normally to said rear wall and extending between said top side wall and said bottom side wall, and a right side wall disposed normally to said rear wall and opposite said left side wall and extending between said top side wall and said bottom side wall; and said means for mounting said panel in said storage cavity includes a means for pivotally mounting said panel in said storage cavity, said means for pivotally mounting said panel in said storage cavity includes:

a left hole defined in said left side wall of said cavity near said top side wall of said cavity, a left elongated pin extending away from said left side surface of said panel, said left pin having a cross-sectional shape configured to pivot within said left hole in said left side wall of said cavity, a right hole defined in said right side wall of said cavity near said top side wall of said cavity, and a right elongated pin extending away from said right side surface of said panel, said right pin having a cross-sectional shape configured to pivot within said right hole in said right side wall of said cavity.

10. An apparatus as in claim 9, wherein:

at least one of said right and left holes in said respective right and left side walls of said storage cavity is elongated in a direction that is generally along a line that is normal to said front surface of said main body.

11. An apparatus as in claim 10, further comprising:

at least one inclined guide disposed near said top side wall of said storage cavity;

wherein at least one of said elongated right and left holes in said respective right and left side walls of said storage cavity has a front end and a rear end, said front end being closer to said front surface of said main body than said rear end and said rear end being closer to said rear wall of said storage cavity than said front end; and wherein said at least one inclined guide is disposed in communication with said front end of said at least one of said elongated right and left holes.

12. An apparatus as in claim 1, wherein:

said panel having a front surface and a back surface disposed opposite said front surface;

said storage cavity being defined by a rear wall, a top side wall disposed normally to said rear wall, a bottom side wall disposed opposite said top side wall, a left side wall disposed normally to said rear wall and extending between said top side wall and said bottom side wall, and a right side wall disposed normally to said rear wall and opposite said left side wall and extending between said top side wall and said bottom side wall; and said means for mounting said panel in said storage cavity includes a means for magnetically engaging said panel in said storage cavity, said means for magnetically engaging said panel in said storage cavity includes:

at least a first magnetic coupling element disposed to extend from said rear wall of said storage cavity, and at least a second magnetic coupling element disposed on said back surface of said panel to be in registry with said magnetic coupling element extending from said rear wall of said storage cavity when said panel is received in said storage cavity.

13. An apparatus as in claim 1, further comprising:

a means for releasing said panel from being mounted in said storage cavity.

14. An apparatus as in claim 13 wherein:

said panel having a front surface and a back surface disposed opposite said front surface, said panel having a left side surface disposed between the left side of said front surface and the left side of said back surface, said panel having a right side surface disposed between the right side of said front surface and the right side of said back surface and opposite to said left side surface; and said means for releasing said panel from being mounted in said storage cavity includes:

a left gripping cavity disposed near said left side surface of said panel and recessed from said back surface;

a left lever pivotally disposed in said left gripping cavity;

a left elongated pin extending from said left surface of said panel, said left elongated pin having a circular cross-sectional shape and pivotally engaging a first end of said left lever;

a left handle disposed in said left gripping cavity and connected to a second end of said left lever opposite said first end of said left lever;

a right gripping cavity disposed near a right side surface of said panel and recessed from said back surface;

a right lever pivotally disposed in said right gripping cavity;

a right elongated pin extending from said right surface of said panel, said right elongated pin having a circular cross-sectional shape and pivotally engaging a first end of said right lever; and a right handle disposed in said right gripping cavity and connected to a second end of said right lever opposite said first end of said right lever.

15. A convertible footboard for a patient support, comprising:

a main body having a front surface and a top surface;

a storage cavity defined in a portion of said main body recessed from said front surface of said main body;

a panel configured to be received in said storage cavity;

a means for mounting said panel in said storage cavity;

a means for releasing said panel from being mounted in said storage cavity; and wherein:

said panel having a front surface and a back surface disposed opposite said front surface, said panel having a left side surface disposed between the left side of said front surface and the left side of said back surface, said panel having a right side surface disposed between the right side of said front surface and the right side of said back surface and opposite to said left side surface; and said means for releasing said panel from being mounted in said storage cavity includes:

at least a first gripping cavity disposed near one of said left side surface and right side surface of said panel and recessed from said back surface;

at least a first lever pivotally mounted in said first gripping cavity;

a first elongated pin extending from said one of said left and right side surfaces of said panel, said first elongated pin having a circular cross-sectional shape and pivotally engaging a first end of said first lever; and a first handle disposed in said first gripping cavity and connected to a second end of said first lever opposite said first end of said first lever.

16. A convertible footboard for a patient support, comprising:

a main body having a front surface and a top surface;

a storage .cavity defined in a portion of said main body recessed from said front surface of said main body, said storage cavity being defined by a rear wall;

a panel configured to be received in said storage cavity;

a means for mounting said panel in said storage cavity; and a pocket member connected to said rear wall of said storage cavity and defining a pocket configured for receiving patient records.

17. An apparatus as in claim 16, further comprising:

a means for mounting said panel above said top surface of said main body.

18. An apparatus as in claim 17, wherein said means for mounting said panel above said top surface of said main body includes:

an elongated left channel defined in said main body and extending through said top surface of said main body;

a left locking groove defined in said main body and having a first portion joining transversely to said left channel;

a left bolt having an elongated left shaft slidably disposed in said left channel of said main body, said left bolt having a handle portion extending transversely of said left shaft, said left bolt being configured so that said handle portion can be slidably received in said left locking groove while an end portion of said left shaft extends above said top surface of said main body;

an elongated right channel defined in said main body and extending through said top surface of said main body;

a right locking groove defined in said main body and having a first portion joining transversely to said right channel; and a right bolt having an elongated right shaft slidably disposed in said right channel of said main body, said right bolt having a handle portion extending transversely of said right shaft, said right bolt being configured so that said handle portion can be slidably received in said right locking groove while an end portion of said right shaft extends above said top surface of said main body.

19. An apparatus as in claim 18, wherein said means for mounting said panel above said top surface of said main body further includes:

a left opening extending into said panel from said back side of said panel;

a right opening extending into said panel from said back side of said panel;

wherein said left and right openings are configured and disposed to receive therein said end portions of said respective left and right shafts when said end portions extend above said top surface of said main body.

20. An apparatus as in claim 19, wherein said front surface of said panel is disposed in a generally horizontal position when said left and right openings receive therein said end portions of said respective left and right shafts extending above said top surface of said main body.

* * * * *